US005078852A

United States Patent [19]

Yee et al.

[11] Patent Number: 5,078,852

[45] Date of Patent: Jan. 7, 1992

[54] PLATING RACK

[75] Inventors: Ian Y. K. Yee; James D. Wehrly, Jr., both of Austin, Tex.

[73] Assignee: Microelectronics and Computer Technology Corporation, Austin, Tex.

[21] Appl. No.: 596,790

[22] Filed: Oct. 12, 1990

[51] Int. Cl.[5] ..... C25D 17/08

[52] U.S. Cl. ..... 204/297 R; 204/297 W

[58] Field of Search ..... 204/297 R, 297 W

[56] References Cited

U.S. PATENT DOCUMENTS

| | | | |
|---|---|---|---|
| 3,939,056 | 2/1976 | Fueki et al. | 204/297 |
| 4,043,894 | 8/1977 | Gibbs | 204/297 |
| 4,100,054 | 7/1978 | DuRocher | 204/297 |
| 4,297,197 | 11/1981 | Salman | 204/297 |
| 4,540,478 | 9/1985 | Mallock et al. | 204/297 |
| 4,561,960 | 12/1985 | Jeannot et al. | 204/297 |
| 4,595,484 | 7/1986 | Takiar et al. | 204/297 |
| 4,714,535 | 12/1987 | Coombes, Jr. et al. | 204/297 |
| 4,801,367 | 1/1989 | Burgess | 204/297 R |
| 4,971,676 | 11/1990 | Doue et al. | 204/297 R |

FOREIGN PATENT DOCUMENTS

| | | | |
|---|---|---|---|
| 197805 | 5/1978 | France | 204/297 R |
| 0019649 | 2/1979 | Japan | 204/297 R |
| 0740870 | 6/1980 | U.S.S.R. | 204/297 R |

OTHER PUBLICATIONS

Mehdizadeh et al., "Optimization of Electrodeposit Uniformity by the Use of Auxiliary Electrodes", Journal of the Electrochemical Society, vol. 137, No. 1, Jan. 1990, pp. 110–117.

"Electroplating Machine Systems for Lab Protection", by International Micro Industries (IMI), P.O. Box 604, Cherry Hill, N.J. 08003, Rev. B, Aug. 16, 1989.

*Primary Examiner*—Donald R. Valentine

*Attorney, Agent, or Firm*—Johnson & Gibbs

[57] ABSTRACT

A plating rack for use in electroplating at least one substrate includes a rack body onto which the subtrate may be placed; a metal ring connected to the rack body so as to surround a substrate placed on the rack body; and bistable, single-tipped cam assemblies for holding a placed substrate in place and for making electrical contact between the metal ring and the substrate.

15 Claims, 2 Drawing Sheets

PLATING RACK

BACKGROUND OF THE INVENTION

1. Field of the Invention

The present invention relates to apparatus for facilitating electroplating and, more particularly, to a wafer holder for use in electroplating wafers and other such substrates.

2. Description of Related Art

The fabrication of microcircuits requires the precise positioning of a number of appropriately doped regions in a slice of semiconductor, which positioning is followed by effectuation of one or more interconnection patterns. These appropriately doped regions typically include a variety of diffusions and implants, cuts for metallizations and gates, and windows in protective cover layers through which connection can be made to bonding pads. For each of these regions a sequence of steps is required, together with a specific pattern layout.

A common method of patterning heretofore has involved a photolithographic transfer followed by etching. As is well known to those skilled in the art, photolithography effects transfer of a desired pattern onto the surface of a silicon wafer by selectively allowing light to strike a thin film of photosensitive material coated on the wafer, certain of which material can then be locally removed based upon its solubility, changed or unchanged, after exposure to the light. Removal of material from areas unprotected by the photosensitive material or "photoresist" is accomplished in an etching step. The etching processes used in integrated circuit ("IC") fabrication can take place either in a liquid ("wet etching") or gas ("dry etching") phase. These processes can also be purely physical (e.g., wherein material is removed by bombardment which high-energy ions), purely chemical (e.g., wherein material is removed by dissolution), or a combination of both (e.g., wherein material is removed by bombardment with reactive ions which also react chemically with the etched material). Recognizing that all etching processes may be characterized by their selectively (i.e., in materials attacked by the etching agent) and degree of anisotropy (i.e., etching in one direction only, as opposed to isotropic etching, wherein material is removed at the same rate in all directions), it should be appreciated that all etching processes involve some degree of compromise in selectivity, anisotropy, or both selectivity and anisotropy.

As it has become desired to create increasingly accurate and dense pattern geometries, those skilled in the art have searched for methods of patterning that lack the "bias-type" compromises of etching processes. One such method that has been and is still being developed is electroplating, that is, the electrodeposition of an adherent coating upon an object. Although electroplating has long been used in patterning printed circuit boards, its use in patterning high density features onto wafers and substrates is still relatively new. One of the advantages of additive patterning approaches, such as pattern electroforming, over subtractive methods, such as etching, that has been discovered is that very little bias in dimension occurs with electroforming and therefore very accurate and dense geometries can be fabricated.

Although electroplating may become a favored technique for patterning high density features onto wafers and substrates, it has heretofore had a number of shortcomings and deficiencies. One of these deficiencies is that thickness variation across a work piece or from item to item is difficult to control. In the printed circuit board industry or in surface finishing industries, the control of plating thickness is not as critical as it is in the industries fabricating high interconnect density substrates or fabricating input/output bond pads. In the latter two types of industries, needless to say, the requirements for controlled and uniform plate thickness are very important.

A problem in plating thickness control is that the local plating rate is dependent not only on the plating bath chemistry and the plating process parameters but also on the geometry and pattern to be plated. For example, there is a general tendency for higher plating rates at corners and edges because higher electric field densities exist in these areas. In pattern plating complex geometries with varying pattern demographics, the electric flux distribution across a wafer or substrate can be very non-uniform.

Another shortcoming and deficiency of electroforming as an approach for patterning wafers and high density interconnect substrates is that very little commercially available equipment exists, so that companies that wish to investigate electroplating of delicate parts such as wafers and interconnect substrates need to develop their own equipment.

SUMMARY OF THE INVENTION

The present invention overcomes the shortcomings and deficiencies of the prior art by providing a plating rack including a rack body, an edge ring assembly, and a cam assembly. The rack body provides a surface onto which a substrate to be electroplated may be placed, the edge ring assembly is disposed so as to surround a substrate placed on the rack body, and the cam assembly serves as a means for both passing current from the ring assembly to a substrate placed on the rack body and as a means for holding that substrate on the rack body. In embodiments of the present invention the rack body may have portions defining a recess into which a substrate may be placed.

According to certain teachings of the present invention the edge ring assembly may be formed of inert metal. In addition, or otherwise, the edge ring assembly may be readily electrically connectable to a power supply via a solid wire. In embodiments of the present invention the edge ring assembly may have a top surface disposed approximately in the same plane as a top surface of substrate placed on the rack body. More precisely, in certain embodiments of the present invention the top surface of the edge ring assembly may be from about 0.01 to about 0.10 inches below the top surface of the substrate.

According to the teachings of the present invention the cam assembly may comprise a plurality of bistable, probe tipped cams held in place by back-side spring-loaded cam followers. In embodiments of the present invention the cams may be readily removable from their followers to facilitate replacement.

Accordingly, it is an object of the present invention to provide an improved wafer holder that may be used to electroplate wafers and substrates.

Another object of the present invention is to provide a plating rack design including a unique external cathode that improves both the accuracy of the targeted plating thickness as well as the uniformity of the thickness across the part that is plated.

Still yet another object of the present invention is to provide a plating rack design that includes a bistable, single probe tipped cam that both holds the substrate in place and provides electrical contact.

BRIEF DESCRIPTION OF THE DRAWINGS

Other objects, advantages and novel features of the present invention will become apparent from the following detailed description of the invention when considered in conjunction with the accompanying drawings wherein.

DETAILED DESCRIPTION OF THE INVENTION

Figure 1:
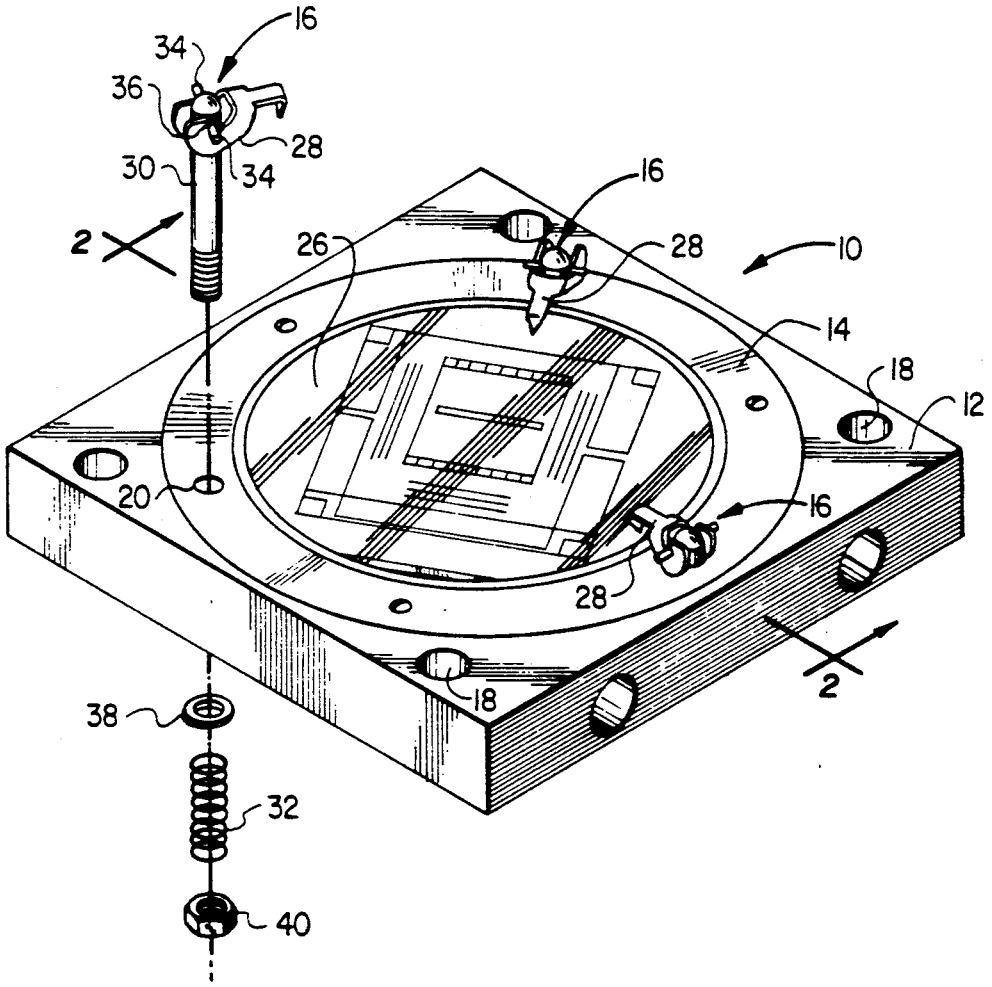
FIG. 1 is a perspective, partially exploded view of a plating rack design according to the teachings of the present invention.

Referring now to the drawings wherein depicted elements are not necessarily shown to scale and wherein like or similar elements are designated by the same reference numeral through the several views and, more particularly, to FIG. 1, there is shown a plating rack, generally designated by reference numeral 10, according to the teachings of the present invention. In general, rack 10 comprises three major subsystems: a rack body 12, an edge ring assembly 14, and at least one cam assembly 16 (three such cam assemblies are shown in the embodiment depicted in FIG. 1).

The rack body 12 functions as a support for the other elements 14, 16 during plating processes. Accordingly, the rack body 12 must be of sufficient size and strength to support those elements 14, 16, and it must also be formed of a material that is not reactive with any chemicals with which it may come into contact during a plating process. In general, any of a number of well known "chemically inert plastics" may be used to form a rack body 12. In an actual embodiment of the present invention that has heretofore been made and used for copper plating, the rack body 12 was formed of polyvinyl chloride and it performed very well. Further, in an actual embodiment of the invention that has heretofore been made the body 14 has been enlarged so as to have four plating stations (although, of course, any number of plating stations could be provided in embodiments of the present invention). The rack body 14 may also either have portions forming a handle (not shown) or a conventional handle (having, e.g., a clamping portion) could be attached to a portion of the rack body 14 to facilitate handling during use.

Figure 2:
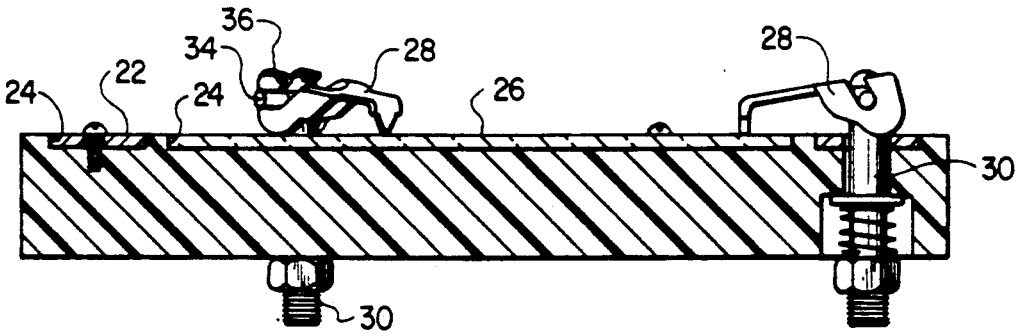
FIG. 2 is a cross-sectional view taken along line 2—2 in FIG. 1.

Referring to both FIGS. 1 and 2 it may be seen that the depicted rack body 12 has portions defining a number of voids (e.g., voids 18, 20, 22 and 24). These various voids perform a number of different functions. Voids 18 are for wiring purposes. More specifically, voids 18 provide a short path for wires interconnecting the ring 14 and the bottom (or "back") of rack bottom 12. The remaining types of voids 20, 22 and 24 perform other functions. Voids 20 help form a portion of the cam assemblies supports discussed further below. Voids 22, one of which is clearly shown in FIG. 2, connect the ring assembly 14 to the rack body 12 as is also discussed further below. Voids 24, which are also best seen in FIG. 2, are recesses into which a silicon wafer 26 may be disposed for plating and into which the ring assembly 14 (discussed further below) may be positioned and mounted. This operation is also discussed further below.

The cam assemblies 16 provide both the mechanical force that holds a wafer 26 in the pocket or recess 24, and the electrical connection that passes current from the edge ring 14 onto the wafer 26. Each cam assembly comprises a cam 28, a cam follower 30, and a spring 32. The cam 28 itself is a bistable, rotatable probe tip that can be easily removed and replaced. It is made from an inert material such as titanium so that electroplated metals such as copper can be etched back without attack of the cam. Having a single tip per cam 28 allows good, uniform contact to be made to the wafer 26 while minimizing the amount of covered (and, hence, unplatable) area. In the design of the present invention, three equally spaced cams 28 (see FIG. 1) provide contact to the wafer. For plating to occur only one good contact is required; however, three or four equally spaced contacts have been found by the inventors of the present invention to be optimum in terms of plating uniformity for round wafers. The tension on the cam 28 is provided by a back-side spring-load cam follower 30, previously mentioned. This "back-side" design minimizes the profile of the rack and eliminates any front side structures that might shadow and disrupt the uniform plating of the wafer. The follower 30 may be seen in the exploded portion of FIG. 1 to have projecting arms 34 that ride in a slot 36 formed by portions of the cam 28. This design is convenient because it allows for easy removal and replacement of cams 28. Such removal and replacement can be effected by simply rotating the cam in its natural direction of rotation until the opening of the slot 36 faces the rack 10. At that point the arms 34 will no longer operate to press the cam downward to the rack and the cam will be free to be removed and replaced. The follower 30 may also be seen in the exploded portion of FIG. 1 to have a generally cylindrical, partially threaded body portion which can receive a washer 38, spring 32 and a nut 40 so as to provide a downward spring loaded action in an assembly 16 as best seen in the right hand side of FIG. 2. The spring used in actually constructed embodiments of the present invention has been made from a spring grade of pure titanium. Of course, as is known to those skilled in the art, titanium is a relatively expensive material. A cheaper material could also be used to form spring 32 as long as that material is compatible with the specific bath used during plating.

The edge ring assembly 14 consists of an inert metal ring that surrounds the outside side perimeter of the wafer to be plated. The front surface of this ring should be approximately the same plane as the wafer to be plated; however, for best uniform plating, the surface should be slightly above the wafer (0.01–0.10"). This edge ring is electrically connected to an independent power supply (not shown) by a solid wire (not shown), preferably an inert tantalum, niobium, titanium, or molybdenum wire insulated with a plastic shrink tube. During plating, this edge ring is cathodically biased and plates up with the wafer. This cathodic ring imparts several key benefits. First, since it plates up simultaneously with the wafer, this ring becomes polarized during the plating process, "robbing" the high current density flux lines that would be present near the wafer edge if the ring was not cathodically charged. This ring improves the plating uniformity across the wafer by moving the high flux density edge-effects away from the wafer and onto the ring. Second, since the rings represent a significant constant area that is plated up, any area variation on the wafer is minimized and thus the wafer to wafer variation is reduced. This is important when the plated pattern on the wafer is small compared to the uncontrolled area variation at the wafer edges. For example, if the pattern has a total area of 2 square centimeters, and the area at the sidewalls of the wafer varies by ±0.5 square centimeters, the total variation can be as high as ±25%. If an edge ring having a constant area of 50 square centimeters is plated up in series with wafer, the area variation goes below ±1%. Third, having the edge ring, especially if it is slightly in front of the wafer, decreases plating on the wafer edges and back of wafers. One of the largest plated area variation on the wafer can be attributed to exposed metal on the edges and backs of wafers. A cathodically charged ring, in the described configuration, would serve as an "electrostatic seal" that robs current flux lines from going to the edges and backs of wafers.

Figure 3:
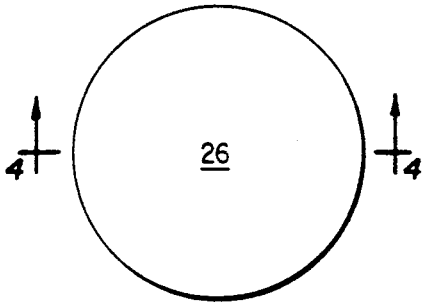
FIG. 3 is a top plan view of a silicon wafer.
Figure 4:
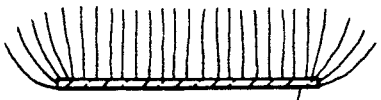
FIG. 4 is a schematic depiction of the flux density lines over the wafer of FIG. 3 during a plating process.
Figure 5:
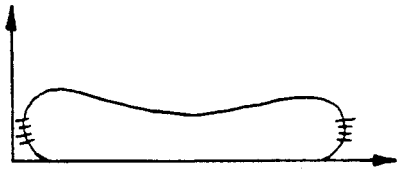
FIG. 5 graphically depicts the effect of flux density shown in FIG. 4.

The operation and effect of the cathode ring assembly is schematically and graphically depicted in FIGS. 3–7. FIGS. 3, 4 and 5 show flux density over a single wafer and the resultant plating thickness on that wafer. FIG. 3 indicates that a solitary wafer 26 is being considered in the FIG. 3, FIG. 4 and associated FIG. 5 views. FIG. 4 shows the flux density lines that form over such a single wafer 26. It is significant to note in FIG. 4 that the flux density lines project generally uniformly and orthogonally upward from the wafer 26, however, at the edge of the wafer the flux density lines bend and congregate. Referring to FIG. 5, it may be seen that this "bending" and "congregating" of flux density lines causes an increase in plating thickness around the outer edge of the wafer 26.

Figure 6:
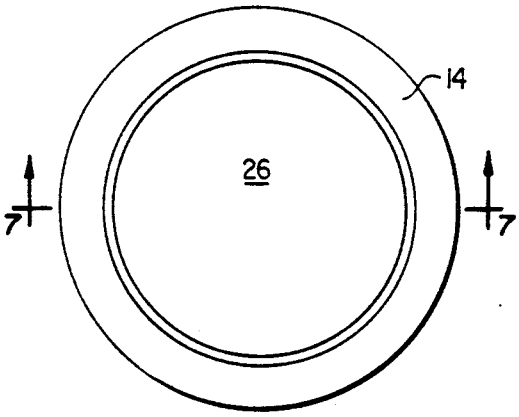
FIG. 6 is a top plan view of an edge ring surrounding a silicon wafer.
Figure 7:
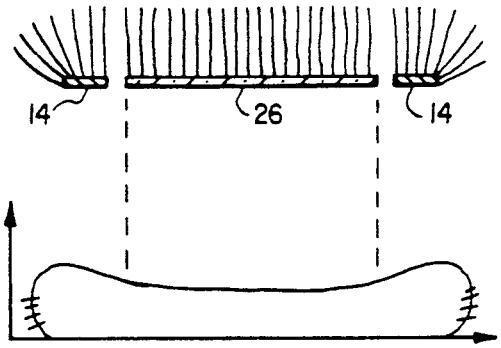
FIG. 7 schematically and graphically depicts flux density and effects therefrom with respect to arrangement of FIG. 6.

Referring now to FIGS. 6 and 7, it may be seen that having a ring assembly 14 around the wafer 26 effectively extends the range of unbent, uncongregated flux density lines across the entire wafer surface, resulting in uniform plating thickness on the wafer. Concentration of flux density lines occurs over the ring assembly 14 where its effects on wafer plating are insignificant.

Based on the foregoing, it should now be clear that the present invention provides an improved wafer holder that can be used to electroplate wafers and substrates. The present invention provides a plating rack design including a unique external cathode that improves both the accuracy of the targeted plating thickness as well as the uniformity of the thickness across the part that is plated. Embodiments of the present invention include a bistable, single probe type cam that both holds the substrate in place and provides electrical contact.

The foregoing description shows only certain particular embodiments of the present invention. However, those skilled in the art will recognize that many modifications and variations may be made without departing substantially from the spirit and scope of the present invention. Accordingly, it should be clearly understood that the form of the invention described herein is exemplary only and is not intended as a limitation on the scope of the invention.

What is claimed is:

1. A plating rack for use in electroplating at least one substrate having an outside edge, said plating rack comprising:

a substantially one piece rack body onto which said substrate may be placed;

an exposed metal ring connected to said rack body so as to completely surround said outside edge of said substrate when placed on said rack body; and means for both passing current from said metal ring to said substrate when placed on said rack body and for holding said substrate in place on said rack body, said means comprising at least one element having only a single point of contact when in contact with said substrate.

2. A rack as recited in claim 1, wherein said metal ring comprises an inert metal ring.

3. A rack as recited in claim 1, wherein said metal ring has a top surface, wherein said substrate has a top surface, and wherein said top surface of said metal ring and said top surface of said substrate are in approximately the same plane when said substrate is placed on said rack body.

4. A rack as recited in claim 3, wherein said top surface of said metal ring is from about 0.01 to about 0.10 inches above said top surface of said substrate.

5. A rack as recited in claim 1, wherein said metal ring is readily electrically connectable to power supply via a wire.

6. A rack as recited in claim 1, wherein said rack body is formed of a chemically inert plastic.

7. A rack as recited in claim 1, wherein said rack body has portions defining a recess into which said substrate may be placed.

8. A rack as recited in claim 1, wherein said means for both passing current from said metal ring to said substrate placed on said rack body and for holding said substrate in place on said rack body comprises a plurality of cam assemblies.

9. A rack as recited in claim 8, wherein each of said plurality of cam assemblies is bistable.

10. A rack as recited in claim 8, wherein each of said plurality of cam assemblies are spring loaded.

11. A rack as recited in claim 1, wherein said substrate further has a back, and wherein said metal ring is further connected to said rack body so as to be slightly in front of said substrate when placed on said rack body, whereby having said metal ring so positioned decreases plating on said outside edge and said back of said substrate during use of said plating rack.

12. A rack as recited in claim 1, wherein said substrate when in place, has an upper surface having a first area; wherein said metal ring has an upper surface having a second area; and wherein said second area is larger than said first area.

13. A plating rack for use in electroplating at least one substrate having an outside edge, said plating rack comprising:

a rack body onto which said substrate may be placed;

a metal ring connected to said rack body so as to surround said outside edge of said substrate placed on said rack body; and means for both passing current from said metal ring to said substrate when placed on said rack body and for holding said substrate when in place on said rack body, said means comprising at least one element having only a single point of contact when in contact with said substrate.

wherein said means for both passing current from said metal ring to said substrate when placed on said rack body and for holding said substrate when in place on said rack body comprises a plurality of cam assemblies, wherein each of said plurality of cam assemblies are held by a spring loaded element that rides in a slot in each of said plurality of cam assemblies, and wherein each of said plurality of cam assemblies can be hand rotated to readily remove them from the spring loaded element.

14. A plating rack for use in electroplating at least one substrate having an outside edge, said plating rack comprising:

a rack body onto which said substrate may be placed;

a metal ring connected to said rack body so as to surround said outside edge of said substrate when placed on said rack body; and means for both passing current from said metal ring to said substrate when placed on said rack body and for holding said substrate when in place on said rack body, said means comprising at least one element having only a single point of contact when in contact with said substrate.

wherein said means for both passing current from said metal ring to said substrate when placed on said rack body and for holding said substrate when in place on said rack body comprises a plurality of cam assemblies, and wherein each of said plurality of cam assemblies has a single probe tip.

15. A rack as recited in claim 14, wherein each of said plurality of cam assemblies has a single rotatable probe tip.

* * * * *